United States Patent [19]

van den Heuvel

[11] 4,302,309

[45] Nov. 24, 1981

[54] METHOD OF MANUFACTURING CATHODES

[75] Inventor: Reinier M. van den Heuvel, Eindhoven, Netherlands

[73] Assignee: U.S. Philips Corporation, New York, N.Y.

[21] Appl. No.: 195,533

[22] Filed: Oct. 9, 1980

Related U.S. Application Data

[62] Division of Ser. No. 84,018, Oct. 11, 1979, Pat. No. 4,252,630.

[30] Foreign Application Priority Data

Oct. 31, 1978 [NL] Netherlands ..... 7810808

[51] Int. Cl.[3] ..... C25D 13/02; C25D 13/12; C25D 17/08

[52] U.S. Cl. ..... 204/181 N; 204/297 R; 204/297 W

[58] Field of Search ..... 204/181 N, 297 R

[56] References Cited

U.S. PATENT DOCUMENTS

| | | | |
|---|---|---|---|
| 3,271,280 | 9/1966 | Shroff | 204/297 R |
| 3,394,819 | 7/1968 | Saville | 204/297 W |
| 3,766,125 | 10/1973 | Hansen et al. | 204/181 N |

*Primary Examiner*—Howard S. Williams

*Attorney, Agent, or Firm*—Thomas A. Briody; David R. Treacy; Robert J. Kraus

[57] ABSTRACT

A method of electrophoretically coating cathode shafts with an emissive layer having excellent mechanical properties, by dipping a jig in which the shafts are placed into an electrophoresis bath. The jig includes a plate formed of electrically insulating material having an electrically conducting layer on one side, with apertures for the cathode shafts defining an opening in the layer. The conducting layer and cathode surface are immersed in an electrophoresis bath, and an electric potential is then applied between the layer and the shafts.

5 Claims, 4 Drawing Figures

METHOD OF MANUFACTURING CATHODES

Figure 1:
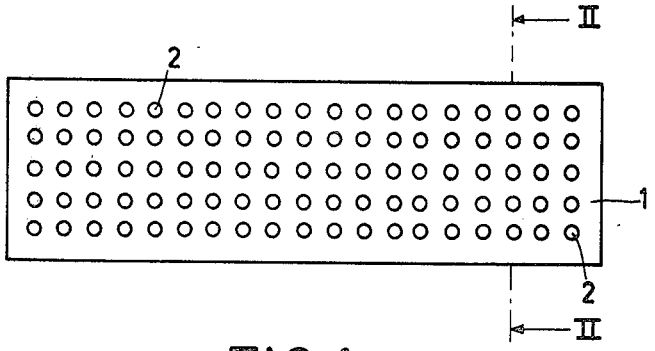

This is a division of application Ser. No. 084,018, filed Oct. 11, 1979, now U.S. Pat. No. 425,630.

The invention relates to apparatus for the manufacture of cathodes, in particular the electrophoretic coating of cathode shafts with an emissive layer.

The invention also relates to a method of manufacturing cathodes by means of such apparatus.

Such cathodes have a wide field of application. They are used, for example, in television display tubes, television camera tubes and oscilloscope tubes. They are used in tubes in which an electron beam or a directed electron flow is to be generated. Such cathodes comprise the following basic components: a heating element, an emissive layer and a support for the emissive layer. In most cases the support consists of a metal cathode shaft. The emissive layer is provided on a part of the surface of said cathode shaft. Said layer may be provided by spraying a layer of suspension onto the support. However, it is possible to provide the emissive layer electrophoretically on the cathode shaft.

Apparatus of the kind mentioned in the opening paragraph is disclosed in British Patent Specification 921,938. The apparatus described in said specification comprises an electrophoresis bath in which a first electrode is present in a suspension. The cathode shafts to be coated are secured in a holder in the apparatus with the closed end on which the emissive layer is to be provided lowermost. The cathode shafts are then lowered down to the surface of the suspension bath, the closed ends of the cathode shafts just contacting the surface of the suspension. The cathode shafts are then raised a small distance above the surface of the suspension, so that the cathode shafts pick up a small liquid column as a result of the surface tension of the suspension. An electric current is then passed through the suspension between the first electrode and the cathode shafts which constitutes a second electrode, so that the ends of the cathode shafts are coated with emissive material from the suspension. The disadvantage of this method and apparatus is that the surface level of the suspension in the electrophoresis bath must be very constant. The surface of the suspension must also be very smooth during the process. Since a suspension in an electrophoresis bath must always be kept in motion, and may in some cases be circulated by pumping, this is substantially impossible.

It is therefore the object of the invention to provide a method and an apparatus in which the surface of the level suspension and the state of the surface of the suspension in the electrophoresis bath play no part.

Apparatus according to the invention of the kind mentioned in the opening paragraph is characterized in that the apparatus comprises a reservoir for containing an electrophoresis suspension and a jig which can be immersed therein and in which cathode shafts can be placed. The jig is composed of a plate of electrically insulating material which is provided on the two surfaces with a first and a second electrically conductive layer. The jig has a large number of perforations in which the cathode shafts can be provided in a fitting manner such that the cathode shafts electrically contact the first electrically conductive layer, and the plate having such a thickness that the side of the shaft to be coated is located at a distance from the second conductive layer, which distance is small in relation to the thickness of the jig, and jig having at least a sealing electrically insulating layer on the side of the first conductive layer. The advantage of such an apparatus is that the thickness and mechanical properties (for example hardness, density, adhesion) of the emissive layer of cathodes manufactured by means of this device are very constant and reproduceable. Moreover, substantially no suspension is wasted so that more expensive emissive materials may also be used. (large quantities of suspension are wasted when providing the emissive layer by means of spraying).

It is also possible to coat only a small part of the surface of cathode shafts with an emissive layer by providing the perforation near the second conductive layer with a shoulder against which the cathode shaft is placed.

A method of electrophoretically coating cathodes with an emissive layer by means of a device according to the invention is characterized in that the cathode shafts are placed in the jig after which the jig is closed, which jig is then dipped in a suspension containing the materials forming the emissive layer, after which the first conductive layer obtains a potential of a few to a few tens of volts relative to the second conductive layer for a few to a few tens of seconds, after which the jig is removed from the suspension and the cathodes are taken out of the jig. The polarity of the potential is determined by the kind of suspension.

Figure 2:
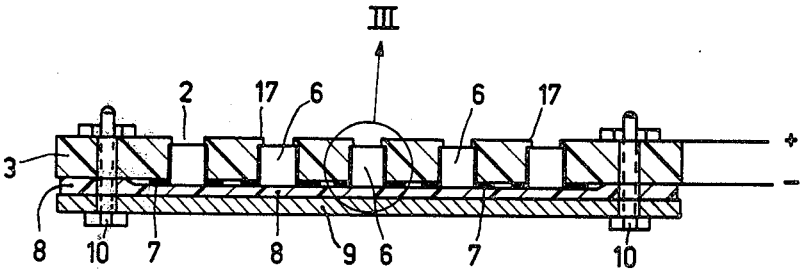
Figure 3:
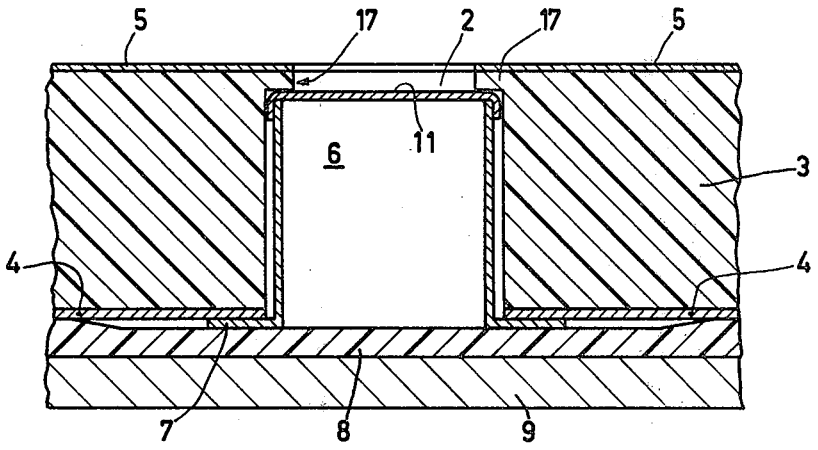

The invention will now be described in greater detail with reference to a drawing in which FIG. 1 is an elevation of a jig for a device used in the method according to the invention, FIGS. 2 and 3 are cross-sectional views of such a jig, and FIG. 4 explains the method in greater detail with reference to a diagrammatic representation of the device according to the invention.

FIG. 1 is an elevation of a jig. The jig 1 has a large number of perforations 2 in which the cathode shafts can be placed. It is not necessary for the cathode shafts to be cylindrical, they may alternatively be box-shaped. Of course, the perforations 2 of the jig will in that case be square.

FIGS. 2 and 3 are cross-sectional views of a jig 1 shown in FIG. 1. The jig is composed of a plate of insulation material 3, for example a plate of polypropylene, having a thickness of 2.4 mm which has a large number of perforations 2 having a diameter of approximately 2 mm. The plate has metal films 4 and 5 on both sides (see FIG. 3), for example a 36 $\mu$m thick copper-nickel alloy. The cathode shafts 6 having flanges 7 are placed in the perforations 2 and electrically contact metal film 4. After placing the cathode shafts 6 in the perforations 2 of the jig, a sealing insulation layer 8, for example a rubber plate, is provided by means of a pressure plate 9 and screws 10. This results in a good sealing.

The surface 11 of the cathode shaft 6 to be coated is located at approximately 0.2 mm from the metal film 5. As a result of the presence of shoulder 17 in the perforation 2, only a central part of the surface 11 is coated.

Figure 4:
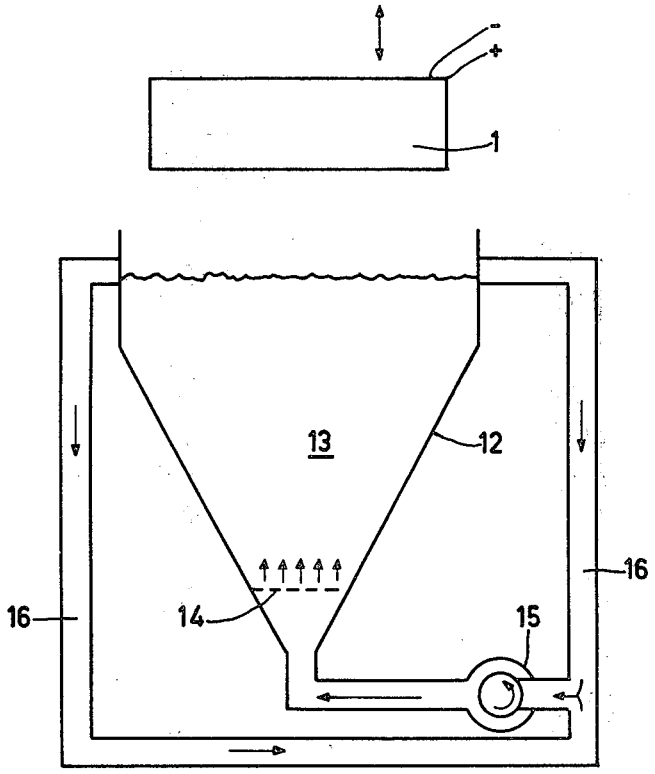

FIG. 4 shows diagrammatically the device according to the invention with reference to which the method according to the invention will be described in greater detail. The device comprises an electrophoresis bath 12 containing the suspension. The composition of the suspension is, for example, as follows:

50% by volume of acetone

45% by volume of ethanol

5% by volume of methanol in which per 100 cc 12 grams of $(BaSr)_{\frac{1}{2}}CO_3$ is dispersed for approximately 5 minutes in a dispersing machine. It will be obvious that suspensions having different compositions and different solvents may alternatively be used.

A sieve 14 to homogenize the flow of suspension is provided at the bottom of the electrophoresis bath. The suspension 13 is circulated continuously via the ducts 16 by means of a pump 15. As a result of this the composition of the suspension in the bath remains homogeneous. The jig 1 is fixed in the device in such a manner that it can be immersed in the electrophoresis bath. As soon as the jig has been immersed in the suspension described contained in the electrophoresis bath, conductive layer 5 obtains a positive potential of 6 volts relative to the surface 11 of the cathode shaft for ten seconds. The jig is then removed from the electrophoresis bath and the cathode shafts with coating are removed from the jig after the emissive layer has dried.

What is claimed is

1. A method of electrophoretically coating cathode shafts with an emissive layer, comprising the sequential steps of providing a plate formed of an electrically insulating material having an electrically conducting layer on at least one side, and an aperture in the plate defining an opening in the layer;

placing a cathode shaft to be coated in the aperture, so arranged that a shaft surface to be coated is within the aperture and is exposed toward said opening and spaced from said opening a distance which is small compared with the plate thickness;

applying a suspension containing substances for forming the emissive layer, at least so as to cover said conducting layer and said shaft surface;

applying an electric potential between said conducting layer and said shaft;

removing said electric potential;

removing said suspension from application to the conducting layer and shaft surface;

drying the emissive material layer adhering to the shaft surface; and removing the cathode shaft from the plate aperture.

2. A method as claimed in claim 1, wherein said applying a suspension step comprises immersing at least said conducting layer and said shaft surface in an electrophoretic bath.

3. A method as claimed in claim 2, wherein said electrically conducting layer is a second layer, the plate includes a first conducting layer on a side opposite said second layer, and said aperture extends through both conducting layers and the insulating material, comprising additionally the steps of providing an electrical connecting path between said shaft and said first layer, and covering said first layer and an end of the shaft adjacent said first layer with a sealing electrically insulating layer, and said applying a potential step comprises applying a potential between said first and second conducting layers.

4. A method as claimed in claim 1, 2 or 3 wherein said electric potential is a potential of a few to a few tens of volts and is applied for a few to a few tens of seconds.

5. A method as claimed in claim 2 or 3, wherein said plate includes a large number of apertures, said placing step includes placing a plurality of shafts in respective apertures, and said immersing step includes immersing the plate including both conducting layers and the sealing layer in the bath.

* * * * *